US011679960B2

(12) United States Patent
Vogel et al.

(10) Patent No.: US 11,679,960 B2
(45) Date of Patent: Jun. 20, 2023

(54) ELEVATOR CAR, ELEVATOR INSTALLATION, METHOD FOR OPERATING AN ELEVATOR SYSTEM AND DOOR DRIVE

(71) Applicant: Inventio AG, Hergiswil (CH)

(72) Inventors: Fabian Vogel, Lucerne (CH); Raphael Zimmermann, Lucerne (CH)

(73) Assignee: INVENTIO AG, Hergiswil (CH)

( * ) Notice: Subject to any disclaimer, the term of this patent is extended or adjusted under 35 U.S.C. 154(b) by 256 days.

(21) Appl. No.: 17/250,828

(22) PCT Filed: Sep. 17, 2019

(86) PCT No.: PCT/EP2019/074852
§ 371 (c)(1),
(2) Date: Mar. 8, 2021

(87) PCT Pub. No.: WO2020/058261
PCT Pub. Date: Mar. 26, 2020

(65) Prior Publication Data

US 2021/0309490 A1 Oct. 7, 2021

(30) Foreign Application Priority Data

Sep. 21, 2018 (EP) ..... 18195960.2

(51) Int. Cl.
*B66B 13/14* (2006.01)
*B66B 13/06* (2006.01)

(52) U.S. Cl.
CPC ..... *B66B 13/143* (2013.01); *B66B 13/06* (2013.01)

(58) Field of Classification Search
CPC ..... B66B 13/143; B66B 13/06
See application file for complete search history.

(56) References Cited

U.S. PATENT DOCUMENTS

| | | | | |
|---|---|---|---|---|
| 3,822,767 | A | 7/1974 | Lowry | |
| 11,286,133 | B2 * | 3/2022 | Trcka | B66B 5/0025 |
| 2009/0050416 | A1 | 2/2009 | Rotboll | |

FOREIGN PATENT DOCUMENTS

| | | | |
|---|---|---|---|
| CN | 101098821 | A | 1/2008 |
| CN | 102482058 | A | 5/2012 |
| CN | 104291174 | A | 1/2015 |
| CN | 104891314 | A | 9/2015 |
| CN | 105026299 | A | 11/2015 |
| CN | 107445038 | A | 12/2017 |
| EP | 0976675 | A1 | 2/2000 |
| EP | 3339234 | A1 | 6/2018 |
| JP | 2009012928 | A | 1/2009 |

(Continued)

*Primary Examiner* — Jeffrey Donels
(74) *Attorney, Agent, or Firm* — William J. Clemens; Shumaker, Loop & Kendrick, LLP

(57) ABSTRACT

An elevator car includes at least one elevator door, a door drive for actuating the elevator door, a sensor for detecting the motor power of the door drive and an evaluating unit that determines, based on the motor power detected, whether there is a deviation in the drive force actuating the elevator door from a reference drive force. The evaluating unit determines whether a deviation occurs due to an obstacle in contact with the elevator door or due to altered external conditions, particularly due to altered pressure conditions and/or air flow.

18 Claims, 2 Drawing Sheets

(56) References Cited

FOREIGN PATENT DOCUMENTS

| | | | |
|---|---|---|---|
| JP | 2015020864 | A | 2/2015 |
| JP | 2015168519 | A | 9/2015 |
| KR | 20150010592 | A | 1/2015 |
| WO | 2006074563 | A1 | 7/2006 |
| WO | 2012093441 | A1 | 7/2012 |
| WO | 2018154655 | A1 | 8/2018 |

* cited by examiner

ELEVATOR CAR, ELEVATOR INSTALLATION, METHOD FOR OPERATING AN ELEVATOR SYSTEM AND DOOR DRIVE

FIELD

The invention relates to an elevator installation, a method for operating an elevator installation and a door drive.

BACKGROUND

Elevator cars usually have elevator doors. These comprise at least one car door which is connected to the elevator car. In addition, there can be a plurality of shaft doors which are arranged at the floors of a building and allow access to the shaft of the elevator.

When opening and closing, the car door and a shaft door are usually connected to one another via a coupling and are moved together by the door drive usually attached to the elevator car.

In tall buildings, considerable air resistance can act against the closing movement or opening movement of the car doors and shaft doors. This air resistance is due to the fact that air penetrates into the elevator shaft from outside the building and experiences a vertically directed flow due to the so-called chimney effect. In most cases, warm air rises in a chimney, or in the elevator shaft. Chimney effects can also be caused by "falling" cold air.

The intensity of the effect depends on the dimensions of the shaft and on variable external conditions, such as temperature, wind speed or air pressure.

The higher the speed of the air in the shaft due to the chimney effect, the more resistance is exerted on the elevator doors when said elevator doors are closed and/or opened. On extremely windy days, the air resistance can exceed the strength of the maximum closing force intended for the elevator doors. For this reason, closing the elevator doors is difficult or even impossible.

U.S. Pat. No. 3,822,767A teaches detecting the wind speed prevailing in the shaft and proportionally adapting the strength of the closing force of the door drive which moves the elevator doors to the strength of the wind speed prevailing in the shaft.

The opening and/or closing of the elevator doors can also be obstructed due to an obstacle located in the region of the elevator doors.

EP0976675 A1 discloses a system for operating an automatic elevator door having a door drive, which system comprises a controller, motor and drive mechanism, as well as an actual value detector for the drive force that is generated or applied. The force applied by the motor to the door is referred to as the drive force or motor force. The closing force or opening force is the force exerted by the door edge or door on an obstacle during a closing process or opening process. On the basis of a mathematical model and the door parameters, a drive force model for the drive force calculates the drive force to be applied during disturbance force-free operation. A limit value generator calculates a force limit value from the drive force model value and a permissible disturbance force. If the force limit value is exceeded, the door is stopped and/or a reversing movement is triggered.

However, the system does not differentiate between obstacles and influences from external conditions. The force limit value can be exceeded, for example, when the chimney effect occurs, after which a door can no longer be opened or closed.

SUMMARY

The aim is to provide an elevator car or an elevator installation, a method for operating such an elevator installation, and door drives which overcome the disadvantages of the prior art and in particular allow operation in tall buildings.

The aim is achieved by an elevator installation comprising at least one elevator car, the elevator installation comprising at least one elevator door and a door drive for actuating the elevator door. The door drive comprises in particular a controller, a motor and a drive mechanism, via which drive mechanism the elevator door can be set in motion. The elevator installation, in particular the elevator car, comprises a sensor for detecting the drive force of the door drive. In particular, the sensor is suitable for measuring the motor current required to open and/or close the elevator door. The measurement takes place in particular during the closing and/or opening time of the elevator door. The elevator installation further comprises an evaluation unit which is designed such that it can be determined, on the basis of the detected or measured drive force, whether there is a deviation between the measured drive force and a reference drive force, the reference drive force being determined depending on the floor.

The aim is also achieved by a method for operating such an elevator installation.

The aim is also achieved by a door drive of such an elevator installation, the door drive being designed to actuate the elevator door.

The elevator installation usually comprises an elevator shaft arranged in a building. Such a building comprises a plurality of floors which are connected by the elevator shaft. Accordingly, passengers in the elevator installation can use the elevator installation to get to different floors of the building.

In an advantageous development of the invention, the elevator installation, in particular the elevator car, comprises at least one sensor unit for measuring or detecting external conditions, in particular pressure conditions, temperature conditions, air flows and/or wind. By means of a sensor unit of this kind, it is possible to detect changed external conditions, in particular meteorological conditions, that are caused by the chimney effect, for example. The sensor unit is preferably part of the door drive.

The sensor unit can in particular also be arranged such that at least one changed external situation is detected that has a strengthening or weakening effect on the chimney effect. For example, the chimney effect can increase or decrease when the outside temperature or the prevailing wind speeds change, and therefore a previously determined reference drive force no longer corresponds to the current conditions.

The changed external conditions can occur due to changed pressure conditions and/or air flows, for example those that arise in changed meteorological conditions due to the chimney effect. The sensor unit can therefore be used to measure, for example, the pressure, the temperature and/or the wind speed, with the corresponding external condition corresponding to the placement of the sensor unit in the elevator installation, for example on the elevator car, in particular on the elevator door. The at least one sensor unit can also be placed such that the pressure in the elevator shaft or pressure differences along the elevator shaft, in other words wind conditions and/or temperatures, can be determined. The measurements, i.e. collections of data, can be carried out at fixed time intervals, for example once a day, or continuously.

The sensor unit for detecting external conditions can be provided at one point in the elevator shaft and/or sensor units can be provided at a plurality of points in the elevator shaft.

The evaluation unit is preferably designed such that the measurement of the at least one detected external condition is taken into account when determining the floor-related reference drive force.

In a further development of the elevator installation, the evaluation unit is designed such that, if there is a change in the external conditions, a corresponding other reference drive force that is already stored is used or a redetermination of the reference drive force is triggered. This correspondingly makes it possible to take into account changed external conditions which can lead, for example, to an increased chimney effect, and therefore, when the chimney effect is increased in this way, a higher reference drive force can become effective for the elevator door.

In a further development of the elevator installation, the evaluation unit is designed to determine a floor-related reference drive force for each floor by means of a floor-related reference measurement of the drive force over the relevant closing time and/or opening time and the at least one condition detected by the sensor unit. Thus, the measured values of the external conditions can be taken into account for determining the reference drive force assigned to the elevator door, and therefore, if necessary, reference drive forces can be corrected to higher values without exceeding a permissible closing force that is exerted on an obstacle by the door leaf.

The reference drive force is accordingly determined by means of the reference measurement of the drive force that is taken over the relevant closing and/or opening time. The reference drive force can be stored as a drive force curve over the closing and/or opening time or as a value or value group, in particular as a value pair. Such a value to be determined is typically, in terms of amount, above the maximum of the measured drive force curve, i.e. greater than the amount of the corresponding measured drive force curve. Or, a value pair is determined, with the two values being above the two extremes of the measured drive force curve in terms of amount. An entire curve can also be stored, which curve corresponds to the pattern of the measured drive force curve.

The closing or opening time of the elevator door comprises the period of time required for a movement of the door leaf/leaves belonging to the elevator door from the open state into the closed state of the elevator door or vice versa.

Accordingly, an updated reference drive force can be determined such that, if necessary, the reference drive force relating to the elevator door can be corrected to higher values without exceeding a permissible closing force that is exerted on an obstacle by the door leaf. The measured values can be used, for example, to weight the determined reference drive forces and to determine the weighted reference drive forces as new reference drive forces. This means, for example, that a chimney effect that is expected to be more pronounced according to the measured values causes a higher new reference drive force.

In addition, values for external conditions, in particular for pressure conditions, temperature conditions, air flows and/or wind, can be detected, using which values the reference drive forces of the respective floors are weighted in order to adapt the reference drive forces to changed external conditions without new measurements of the drive forces.

The reference drive force for each floor is preferably determined from a reference measurement carried out for this floor, and stored. Reference measurements can also be carried out only for at least one of the floors and the reference drive forces can be calculated, in particular interpolated, for the remaining floors. A chimney effect which is always present to a certain extent is thus taken into account from the outset.

The measurements can be used, for example, for extrapolating or interpolating drive force measurements for individual floors to further reference drive forces on other floors.

The reference measurement and preferably the determination of the reference drive force can be carried out before the start of regular drive operation. The reference drive forces are preferably updated during the drive operation, in order to also satisfy external conditions that may change slightly. For this purpose, further reference measurements can be carried out at regular time intervals or continuously during regular drive operation, in order to update the reference drive force for one of the elevator doors.

In particular in tall buildings in which a strong chimney effect can occur, it is expedient to use floor-specific reference drive forces so that the elevator doors do open and/or close in the event of air resistance caused by the chimney effect. In the case of a reference drive force that is uniform for all floors, the air resistance caused by the chimney effect can be deemed an obstacle and consequently the movement, in particular the closing of the elevator door, is prevented.

The reference drive force typically has different values for different floors on which the elevator door is opened or closed, in particular in tall buildings.

The reference drive forces for the floors are preferably stored in the evaluation unit. In particular, the reference drive force can be determined using a value that is compared with the maximum value of the drive force curve in terms of amount, or using a value pair that is compared with the two extremes of the drive force curve during the acceleration phase and the braking phase.

Alternatively, the reference drive force can be determined as a reference drive force curve which is compared with the progression of the drive force over the closing and/or opening time. The drive force curve typically has different phases, specifically an acceleration phase, a sliding phase and a braking phase.

In a preferred embodiment of the invention, the elevator car comprises an adjustment unit which is designed such that a stop or a reversing movement of the elevator door can be triggered as a result of a particular deviation of the measured drive force from the reference drive force. The adjustment unit is preferably part of the door drive.

The data measured during normal operation of the elevator installation can be forwarded to the evaluation unit and/or to an adjustment unit, it being possible for the evaluation unit or the adjustment unit to be part of a central controller of the elevator installation.

The evaluation unit is designed such that the measured drive force is compared with the reference drive force of the corresponding elevator door.

In contrast to comparing with a reference drive force that is independent of the floor, the present method can be used to decide whether an increased drive force occurs due to an obstacle or a changed external condition. The latter is taken into account in a floor-dependent reference drive force, which is based on a measurement at different floors.

After a deviation between the measured drive force and the reference drive force has been determined, the door is advantageously stopped and/or a reversing movement is triggered.

A deviation of this kind between the measured drive force and the reference drive force exists when at least one extreme value of the measured drive force curve exceeds the value of the reference drive force or at least one value of the reference drive force value pair in terms of amount or when the pattern of the measured drive force curve deviates starkly from the pattern of the reference drive force curve.

The evaluation unit is designed in particular to determine whether an obstacle is in contact with the elevator door. In addition to determining the drive force, the detection of external conditions can be taken into account when determining whether there is an obstacle present.

In addition, by means of the measurements of the drive force, in particular if no stop and no reversing movement is triggered, an updated reference drive force can be determined, at least for the relevant floor. During disturbance-free operation, each measurement can be used to check for an obstacle and to update the reference drive force.

Alternatively or in addition, the measured values of the external conditions can be stored together with the reference drive forces.

The elevator door consists in particular of a car door and a shaft door, it being possible to couple the car door to the shaft door at one floor such that the car door and the shaft door can be moved by the door drive as an elevator door. The elevator door can alternatively also consist of one car door if the shaft door can be opened and closed separately and/or manually, for example. Alternatively, the elevator door can consist of a shaft door. The car door or the shaft door each comprise at least one door leaf, which door leaf can be moved between an open position and a closed position of the elevator door by the door drive.

DESCRIPTION OF THE DRAWINGS

The invention is explained below with reference to examples shown in the drawings. In the drawings.

DETAILED DESCRIPTION

Figure 1:
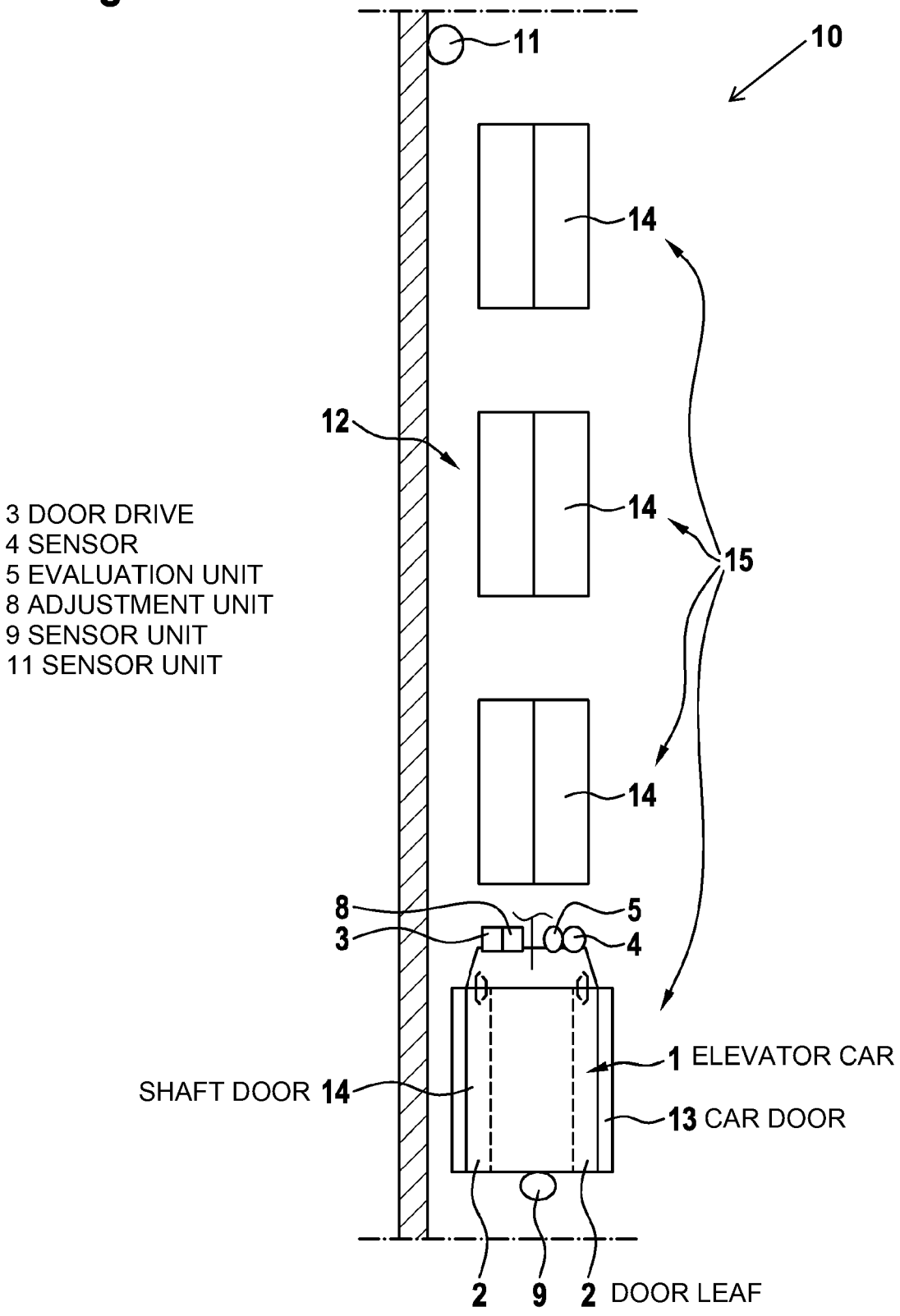
FIG. 1: is a schematic view of an elevator installation.

FIG. 1 is a schematic view of an elevator installation 10. The elevator installation 10 comprises an elevator shaft 12 and an elevator car 1.

The elevator car 1 comprises a car door 13 having two door leaves 2, it being possible to couple the car door 13 to one of a plurality of shaft doors 14 at a given point in time. One of these shaft doors 14 is arranged at each floor 15. As shown in FIG. 1, an elevator door consists of the car door 13 and the lower shaft door 14 coupled to the car door 13.

The elevator car 1 has a door drive 3 for actuating the car door 13 and the shaft door 14 coupled to the car door 13. The elevator car 1 also has a sensor 4 for detecting the motor power of the door drive 3, and an evaluation unit 5. The evaluation unit 5 makes it possible to determine whether a detected maximum drive force 6*a*, 6*b* (see for example FIG. 3) deviates from a floor-dependent reference drive force 7*a*, 7*b* (see for example FIG. 3).

Since the reference drive force 7*a*, 7*b* is dependent on the floor, it can be reliably decided whether there is an obstacle present that is in contact with the elevator door.

The elevator car 1 comprises an adjustment unit 8. If the measured drive force 6*a*, 6*b* deviates from the reference drive force 7*a*, 7*b*, the adjustment unit 8 triggers a stopping or reversing movement of the elevator door.

The elevator car 1 comprises a sensor unit 9 for measuring pressure conditions, temperature conditions, air flows and/or wind. Alternatively or additionally, a sensor unit 11 for detecting external conditions, in particular pressure conditions, temperature conditions, air flows and/or wind, can be arranged on the elevator shaft 12. This means that the sensor unit 11 can optionally be arranged outside the elevator shaft 12, and the measured values obtained by the sensor unit 11 are taken into account when determining the at least one reference drive force 7*a*, 7*b*.

Figure 2:
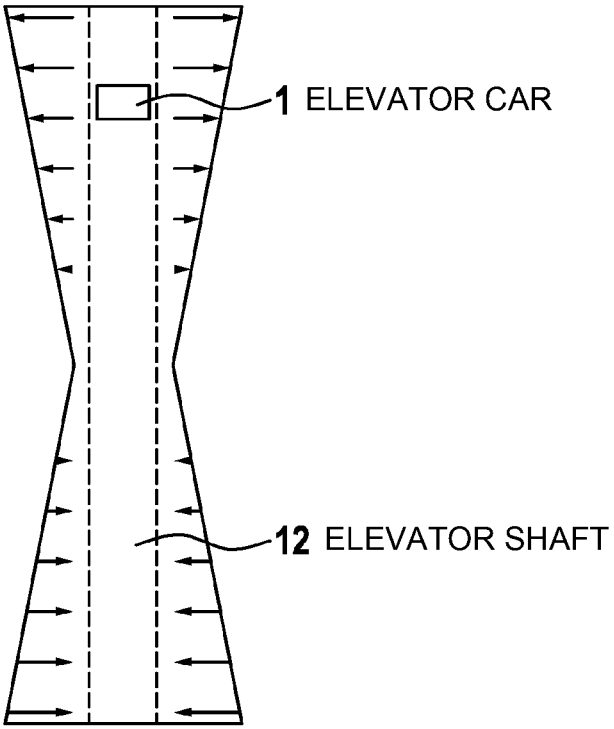
FIG. 2: is a schematic view of the chimney effect.

An effect of the chimney effect is shown schematically in FIG. 2. Since the elevator shaft 12 is typically in contact with the environment via the building doors and the elevator doors, warm air can penetrate into the shaft. This warm air rises up, which means that the elevator car 1 experiences a lower pressure in the lower region of the elevator shaft 12 than in the upper region of the elevator shaft 12.

Figure 3:
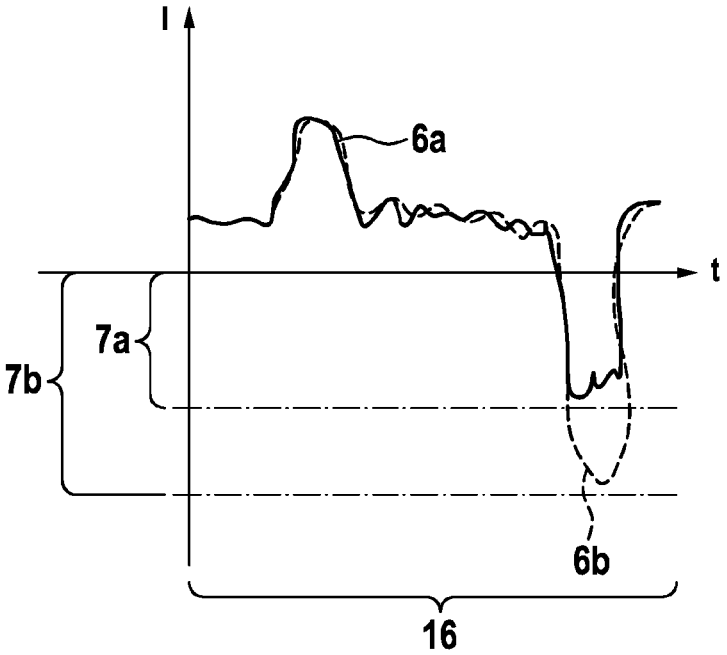
FIG. 3: is an exemplary graph in which, for two floors, the motor current is plotted as a measure for the drive force against time.

FIG. 3 shows an exemplary graph in which, for two floors, the motor current I is plotted as a measure for the drive force 6*a*, 6*b* against the time t, in this case against the length of the door closing time 16.

The solid line corresponds to the drive force 6*a* on a middle floor. The dashed line corresponds to the drive force 6*b* on an upper floor where the chimney effect comes into play.

A reference drive force 7*a*, 7*b* can be determined, for each of the two floors, from the temporal behavior of the drive force 6*a* using the maximum value in terms of amount. The reference drive force can be determined, for example, by multiplying the amount of the maximum by, for example, 1.1 or 1.2.

The reference drive forces for the remaining floors can be determined in further measurements or can be extrapolated from these values 7*a*, 7*b*.

In regular operation, the elevator door is only stopped or a reversing movement is only initiated when the drive force exceeds the reference drive force for the relevant floor.

Alternatively, the reference drive force can also be stored as a pattern of the drive force behavior over time. A stopping or a reversing movement takes place if the curves deviate. For this purpose, a standard for characterizing the deviation and a corresponding limit value are defined. When making a decision about the deviation of the curve pattern, soft obstacles can also be taken into account.

In addition, values for external conditions, in particular for pressure conditions, temperature conditions, air flows and/or wind, can be detected, using which values the reference drive forces of the respective floors are weighted in order to adapt the reference drive forces to changed external conditions without new measurements of the drive forces.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation including an elevator car, an elevator door and a door drive for actuating the elevator door, the door drive comprising:

a sensor detecting a drive force of the door drive when the door drive is actuating the elevator door of the elevator installation;

a sensor unit detecting at least one external condition influencing actuation of the elevator door by the door drive, the sensor unit being arranged inside or outside an elevator shaft in which the elevator car moves;

an evaluation unit determining whether the detected drive force deviates from a reference drive force, wherein the reference drive force was previously determined by the evaluation unit from a reference measurement carried out by the sensor and depends on a floor of the elevator installation at which the elevator door is positioned during the actuation; and wherein the evaluation unit accounts for the detected at least one external condition when determining the reference drive force, and when there is a change in the at least one external condition, the evaluation unit determines whether the detected drive force deviates using for the reference drive force either a corresponding other reference drive force that was previously stored or a reference drive force redetermined by the evaluation unit.

2. The elevator installation according to claim 1 wherein the sensor detects the drive force of the door drive by measuring a motor current of the door drive.

3. The elevator installation according to claim 1 wherein the sensor unit detects the at least one external condition as one of pressure conditions, temperature conditions, air flows and wind.

4. The elevator installation according to claim 1 wherein the evaluation unit determines whether the detected drive force deviates by exceeding the reference drive force.

5. The elevator installation according to claim 1 including an adjustment unit as a part of the door drive or as part of an elevator controller for the elevator installation, and wherein at least one of the evaluation unit and the adjustment unit triggers a stop or a reversing movement of the elevator door when the detected drive force exceeds the reference drive force.

6. The elevator installation according to claim 1 wherein the sensor unit is fixed to the elevator car.

7. The elevator installation according to claim 1 wherein the sensor unit is fixed in the elevator shaft.

8. The elevator installation according to claim 1 wherein the elevator installation has a plurality of floors and the evaluation unit determines the reference drive force for each of the floors by:

measuring a drive force over at least one of a closing time and an opening time of the elevator door at each of the floors; and accounting for the at least one external condition detected by the sensor unit when the elevator door is at each of the floors.

9. The elevator installation according to claim 1 wherein the evaluation unit determines whether an obstacle is in contact with the elevator door when the door drive is actuating the elevator door.

10. The elevator installation according to claim 1 wherein the evaluation unit uses either the drive force detected for the elevator door positioned at a floor of the elevator installation or the reference drive force for the floor, and further uses the at least one external condition detected by the sensor unit to calculate the reference drive force for at least one other floor of the elevator installation.

11. The elevator installation according to claim 1 wherein the evaluation unit stores the reference drive force for each floor of the elevator installation.

12. The elevator installation according to claim 11 wherein the reference drive force is a reference drive curve or a value.

13. A method for operating an elevator installation, the elevator installation including an elevator car, an elevator door and a door drive for actuating the elevator door, the method comprising the steps of:

detecting with a sensor a drive force of the door drive actuating the elevator door;

detecting with a sensor unit an external condition influencing the actuating of the elevator door, the sensor unit being arranged inside or outside an elevator shaft in which the elevator car moves;

determining a reference drive force per each floor of the elevator installation based upon at least one reference measurement of the drive force and the detected external condition; and when there is a change in the external condition, using for the reference drive force either another reference drive force that was previously stored or a redetermined reference drive force based upon the changed external condition.

14. The method according to claim 13 including determining the reference drive force per each floor over at least one of a closing time and opening time of the elevator door at each of the floors.

15. The method according to claim 13 including the steps of:

measuring the drive force using the sensor for at least one of opening and closing the elevator door during a normal operation of the elevator installation; and comparing the measured drive force with the reference drive force to determine whether there is a deviation.

16. The method according to claim 15 including measuring the drive force based upon a motor current of the door drive.

17. The method according to claim 15 including stopping or reversing movement of the elevator door when the measured drive force exceeds the reference drive force.

18. A door drive for actuating an elevator door, the door drive comprising:

a sensor detecting a drive force of the door drive when actuating the elevator door;

an evaluation unit determining whether the detected drive force deviates from a reference drive force; and wherein the evaluation unit determines the reference drive force for each floor of an elevator installation at which the elevator door is actuated from at least one reference measurement of the drive force over at least one of a closing time and an opening time of the elevator door, and when there is a change in external conditions, the evaluation unit uses for the reference drive force either a corresponding other reference drive force that is already stored or a redetermined reference drive force.

* * * * *